United States Patent [19]

Bellis et al.

[11] Patent Number: 4,836,269

[45] Date of Patent: Jun. 6, 1989

[54] FORMING APPARATUS HAVING CATALYST INTRODUCTION SIMULTANEOUS WITH SAND INJECTION

[75] Inventors: Kenneth E. Bellis, Maple Heights, Ohio; Jackson E. Brown, Sterling Heights; Pheroze J. Nagarwalla, Rochester, both of Mich.; James Rea, Parma, Ohio

[73] Assignee: Roberts Corporation, Lansing, Mich.

[21] Appl. No.: 186,672

[22] Filed: Apr. 21, 1988

Related U.S. Application Data

[63] Continuation of Ser. No. 885,361, Jul. 14, 1986, abandoned.

[51] Int. Cl.[4] ..... B22C 15/24; B22C 9/12

[52] U.S. Cl. ..... 164/200; 164/16

[58] Field of Search ..... 164/20, 21, 15, 16, 164/200–202; 222/145

[56] References Cited

U.S. PATENT DOCUMENTS

| | | | |
|---|---|---|---|
| 3,073,534 | 1/1963 | Hampshire | 239/422 |
| 3,145,438 | 8/1964 | Kottke et al. | 164/16 |
| 3,191,870 | 6/1965 | Willett | 239/403 |
| 3,381,588 | 5/1968 | Londal | 91/411 |
| 3,391,812 | 11/1976 | Kopp et al. | 164/200 |
| 3,461,948 | 4/1967 | Londal et al. | 164/201 |
| 3,584,179 | 6/1971 | Schroeder | 219/69 |
| 3,587,982 | 6/1971 | Campbell | 222/145 |
| 3,590,902 | 7/1971 | Walker | 164/43 |
| 3,783,224 | 6/1974 | Schroeder | 219/69 E |
| 3,830,284 | 8/1984 | Mindock | 164/200 |
| 3,937,272 | 2/1976 | Flora et al. | 164/16 |
| 3,947,420 | 3/1976 | Bardet | 260/38 |
| 3,993,224 | 11/1976 | Harrison | 222/145 |
| 3,994,332 | 11/1976 | Kopp | 164/21 |
| 4,050,500 | 9/1977 | Steinbacher | 164/16 |
| 4,068,701 | 1/1978 | Emblem et al. | 164/16 |
| 4,070,196 | 1/1978 | Kraak et al. | 106/38.35 |
| 4,121,646 | 10/1978 | Rikker | 164/21 |
| 4,132,260 | 1/1979 | Lüber | 164/16 |
| 4,141,470 | 2/1979 | Schulte et al. | 222/137 |
| 4,171,091 | 10/1979 | van Hardeveld et al. | 239/8 |
| 4,176,114 | 11/1979 | Stewart et al. | 260/42.29 |
| 4,268,425 | 5/1981 | Gardikes | 260/19 A |
| 4,366,266 | 12/1982 | Mitsopoulos et al. | 523/143 |
| 4,421,873 | 12/1983 | Seeney et al. | 523/145 |
| 4,531,565 | 7/1985 | Uzaki et al. | 164/200 |
| 4,540,724 | 9/1985 | Donnavant et al. | 523/143 |
| 4,582,224 | 4/1986 | Proksa et al. | 222/145 |

FOREIGN PATENT DOCUMENTS

| | | | |
|---|---|---|---|
| 3023949 | 7/1982 | Fed. Rep. of Germany | 164/200 |
| 1496753 | 10/1967 | France | 164/200 |
| 2504035 | 10/1982 | France | 164/200 |
| 6754 | 1/1981 | Japan | 164/15 |
| 130757 | 8/1982 | Japan | 164/200 |
| 939160 | 6/1982 | U.S.S.R. | 164/200 |
| 780039 | 7/1957 | United Kingdom | 164/200 |

*Primary Examiner*—Nicholas P. Godici
*Assistant Examiner*—Samuel M. Heinrich
*Attorney, Agent, or Firm*—John R. Benefiel; Raymond J. Eifler

[57] ABSTRACT

An apparatus and method for simultaneously injecting forming material (14) and a curing additive into a form (22). The apparatus (10) includes a container (12) of forming material (14) interconnected by a conduit (20) to a forming cavity (22). Forming material (14) is discharged into cavity (22) through conduit (20). An integrally formed chamber (36) is provided for simultaneously supplying additive to the discharging forming material (14). Forming material (14) is forced into cavity (22) while simultaneously forcing the additive into the path of the discharging forming material (14).

8 Claims, 3 Drawing Sheets

FORMING APPARATUS HAVING CATALYST INTRODUCTION SIMULTANEOUS WITH SAND INJECTION

This application is a continuation, application Ser. No. 885,361, filed July 14, 1986, now abandoned.

The present invention relates to foundry equipment and more specifically to an apparatus and method for forming sand cores and sand molds.

BACKGROUND ART

Sand molds are commonly used as cores for casting processes in which a flowable material is cast around the sand core to form a part. When sand is employed to form the sand cores, it must be conditioned and controlled to give satisfactory and uniform results. Typically, the sand is conditioned with additives to meet four requirements: refractoriness, cohesiveness, permeability, and collapsibility. The various methods for conditioning sand generally fall within two broad categories: the "hot box" method and the "cold box" method. Each method requires the additives to be combined with the sand and then the mixture to be cured. The curing stage is what differentiates the two methods.

U.S. Pat. No. 4,050,500 issued Sept. 27, 1977, titled "Method of Making a Shell Mold" discloses one example of the hot box method in which a mixture of sand and a thermosetting binder are injected into a mold. After injection, the mold is heated to cure the composition. Examples of the hot box method are disclosed in U.S. Pat. No. 3,461,948 issued Aug. 19, 1969, titled "Blow Plate Assembly", and U.S. Pat. No. 4,068,701 issued Jan. 17, 1978, titled "Refractory Materials".

There are several disadvantages in the hot box method. Costly heating equipment is needed to heat the core box and keep it hot to polymerize the resin. If the core box cools, the lag time necessary to reheat the core box slows production time. Also, the temperature of the core box must be closely regulated to insure proper polymerization of the resin. Further, the core box is costly because it must be able to withstand the continuous heat.

The cold box method does not require the addition of heat. Typically, the cold box method requires a resin to be mixed with the sand and then polymerized by the action of a curing agent such as catalyst. Examples of resin and catalyst mixtures are disclosed in the following U.S. Patents:

| U.S. Pat. No. | Issue Date | Title |
|---|---|---|
| 4,540,724 | 9/10/85 | Phenolic Resin-Polyioscyanate Binder Systems Containing a Phosphorus Halide and Use Thereof |
| 4,421,873 | 12/20/83 | Oxidatively Coupled Cold-Set Binders |
| 4,366,266 | 12/28/82 | Binder Compositions and Process for Making Molded Products Therewith |
| 4,268,425 | 5/19/81 | Phenolic Resin-Polyisocyanate Binder Systems Containing a Drawing Oil and Use Thereof |
| 4,176,114 | 11/27/79 | Process for Manufacturing Sand Cores and Molds |
| 4,070,196 | 1/24/78 | Binder Compositions |
| 3,947,420 | 3/30/76 | Method for Producing Foundry Molds and Cores as Well as Products Thereby Obtained |
| 3,590,902 | 7/6/71 | Production of Foundry Cores and Molds |

Typically, in the cold box method, a mixture of sand and resin is blown into the core box in one station of the forming operation. The core box is then transferred by a transfer mechanism to a station for adding the catalyst or alternately, the station is transferred to the core box. A catalyst is then introduced into the mold causing the resin to harden.

One of the disadvantages encountered in the cold box method is the necessity of transferring the core box. Depending upon the size and complexity of the machine and core box, the cost of the transfer mechanism could account for several thousand dollars. Further, the machine cycle time is increased by 3 to 10 seconds for the transfer motion and the core requires between 1 and 10 seconds for the addition of the catalyst, excluding purge time. Still further, there is the problem of premature curing of the catalyst/mixture composition in the cold box methods that do not employ an additive station.

One attempt was made to solve the problem of premature curing in one type of the cold box method. Typically, in this type of method, the catalyst and resin coated sand are mixed before they are introduced into the forming box. When this method is used, the curing process begins before the catalyzed-resin sand mixture is actually forced into the forming box. Less reactive resin-catalyst mixtures are not completely satisfactory because they require longer time to cure which slows production. U.S. Pat. No. 3,994,332 issued Nov. 30, 1976 and titled "Apparatus and Method for Manufacturing Cores and Molds With Means for Independently Releasing Catalyst and Resin Mixes", discloses a method and apparatus for forming core molds having two hoppers, wherein the first hopper dispenses a catalyst-polymerizable resin coated sand into a mixing tube while the second hopper dispenses a catalyst coated sand into the mixing tube. The two coated sand particles intermix prior to being injected into the mold resulting in minimal polymerization prior to injection.

The main disadvantage with the method disclosed in U.S. Pat. No. 3,994,332 is the complexity of the machinery required to mix the two sands. The machine is clearly not adaptable to present forming machinery and would require total replacement of all machinery in the foundry.

SUMMARY OF THE INVENTION

The present invention overcomes the above disadvantages by providing a forming apparatus having catalyst introduction simultaneous with sand injection and a related forming method. The apparatus includes an injector for simultaneously introducing forming material and curing additive into a forming cavity.

The injector of the present invention is particularly useful in a forming apparatus having a container of forming material, such as for example resin coated sand, and a forming cavity positioned a spaced distance from the container. The injector is characterized by a conduit interconnecting the container and cavity so that resin coated sand can be discharged from an outlet in the container through the conduit into the cavity.

The injector is further characterized by a chamber which is interconnected to a supply of curing additive or catalyst for mixing with the sand. A passage is provided to direct the curing additive to the discharge end of the conduit. In this way, forming material and additive can be simultaneously discharged and intermixed before being deposited within the cavity. To facilitate intermixing, a mixing region is provided between the discharge end of the conduit and the cavity.

The chamber is preferably provided in an additive manifold. The manifold includes an opening therein which in axial alignment with the outlet in the container. A portion of the passage is defined by the outer wall of the conduit and the wall of the bore in the plate.

The method of forming a part in accordance with the present invention includes the steps of forcing forming material from the container into the forming cavity through the conduit, while simultaneously forcing additive from the chamber through the passage into the path of the discharging sand. In this manner, the forming material and additive are thoroughly intermixed before being deposited in the forming cavity.

The method is further characterized by the steps of pressurizing the container to discharge the forming material while simultaneously pressurizing the chamber to discharge additive. Once the cavity is filled, the flow of forming material and additive are stopped. Purging fluid is then forced through the passage forcing additive throughout the forming cavity.

A primary advantage of the present invention is the simultaneous injection of the forming material and curing additive. This thoroughly intermixes the curing additive with the forming material to insure proper curing of the formed part. In this way, stronger parts with the desired qualities can be obtained.

Another advantage of the present invention is the cost savings of avoiding expensive transfer machinery. As discussed above, conventional forming machinery requires a separate station for adding curing additive. The present invention includes an additive manifold as an integral part of the apparatus so that the additive may be simultaneously injected. Further, the manifold may be adapted for use on existing equipment, thereby reducing costs.

A further advantage of the invention is the savings of production time in not having to make the transfer. Still further, there is a savings of time which would usually be needed for injecting the curing additive at the separate station.

DETAILED DESCRIPTION OF THE INVENTION

Figure 3:
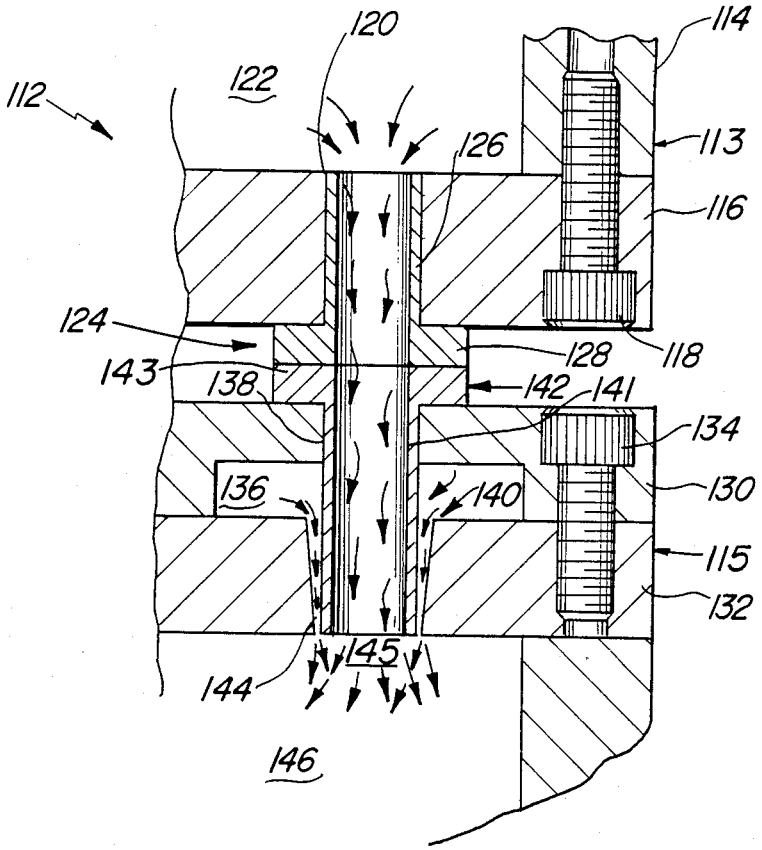

FIG. 3. is a cross-section of a still further embodiment of the present invention.

Figure 1:
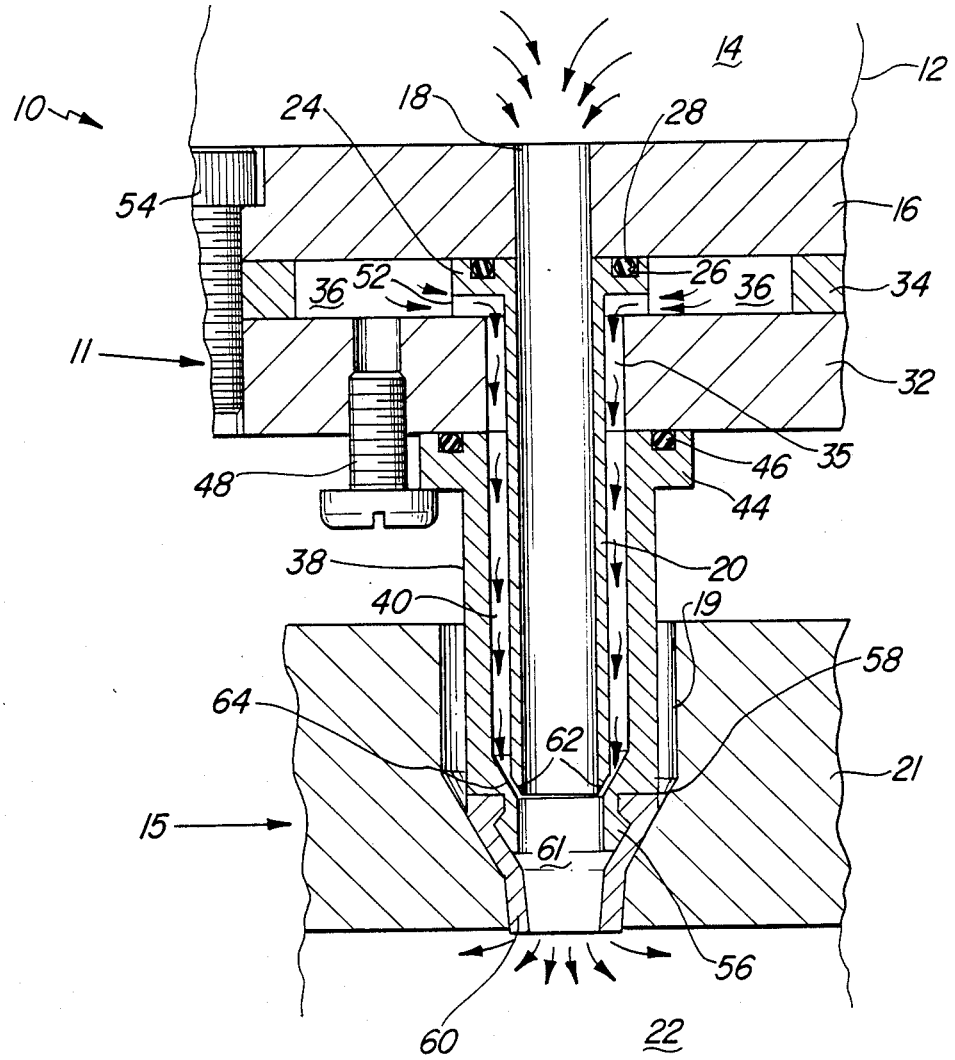
FIG. 1 is a cross-section of one embodiment of the forming apparatus of the present invention.

With reference to FIG. 1, the forming apparatus of the present invention is shown generally at 10 having an injector head 11 and forming base 15. Head 11 includes a container or magazine 12 which contains a quantity of forming material 14, such as for example, resin coated sand. The base of magazine 12 is formed by a blow plate 16 having a bore or passage 18 therethrough for the discharge of forming material 14. Conduit 20 is sealingly mounted to the bottom surface of blow plate 16 and interconnects magazine 12 with forming base 15.

Forming base 15 includes a forming cavity 22 within a form 21. Form 21 may be either a mold box or core box. Form 21 has a countersunk bore 19 for receipt of conduit 20 and an additive tube 38 which is concentric with conduit 20. The head 11 is preferrably reciprocated with respect to base 15 to insert conduit 20 and tube 38 into bore 19. Alternatively, however, base 15 may be reciprocated with respect to head 11.

The conduit 20 is substantially tubular in shape with a mounting flange 24 at one end thereof for mounting to blow plate 16. Flange 24 has a groove 26 formed therein for receipt of an O-ring 28 to insure sealing engagement between the flange 24 and the blow plate 16.

Mounted directly below blow plate 16 a plate defining an additive manifold 32. A chamber 36 is defined by the facing surfaces of manifold 32 and plate 16. Chamber 36 is connected to a supply of curing additive which when mixed with the forming material 14 will cure the combination of forming material 14 and additive to form the part. Spacers 34 are used to define the area of chamber 36. Of course, means other than spacers 34 may be used to provide the necessary spacing. An opening 35 is provided in manifold 32 and is axially aligned with bore 18 for receipt of conduit 20. Opening 35 has a larger diameter than conduit 20 to permit additive to flow out of chamber 36 into additive tube 38 which is positioned about conduit 20.

Conduit 20 and tube 38 are preferrably concentric. The interior diameter of tube 38 is greater than the outer diameter of conduit 20 to form a passage 40 therebetween. In this manner, additive in chamber 36 can be forced through opening 35 and passage 40 to the discharge end of conduit 20. A mounting flange 44 is provided for mounting tube 38 to manifold 32. An O-ring 46 is provided between flange 44 and manifold 32 to insure proper sealing. A fastener 48 may be used to removably mount tube 38 on manifold 32.

To permit additive to flow from chamber 36 into opening 35, space must be provided between flange 24 and the facing surface of manifold 32. In the preferred embodiment, notches 52 are formed in flange 24 to permit the free flow of additive. In this manner, fasteners 54 may be used to mount manifold 32 to plate 16 while simultaneously retaining conduit 20 between the two plates. Other methods may be used to secure flange 24; for example, conduit 20 may be bolted to plate 16.

Mounted on the opposite end of tube 38 is a resilient nozzle 60. Tube 38 is notched to form tabs 56 for receipt of complimentary tabs 58 on nozzle 60 to fasten it to tube 38. A mixing region 61 is defined by the interior of nozzle 60. In the preferred embodiment, the discharge ends of conduit 20 and tube 38 are sloped inwardly at 62 and 64 respectively to direct the discharging additive into the path of the discharging material 14 within region 61. Region 61 permits turbulent mixing of the additive and material 14 immediately before entry into cavity 22. In this manner, the additive and material 14 are thoroughly and uniformily intermixed prior to deposit. Further, nozzle 60 facilitates alignment of tube 38 in bore 19 and seals conduit 20 and tube 38 within bore 19.

Figure 2:
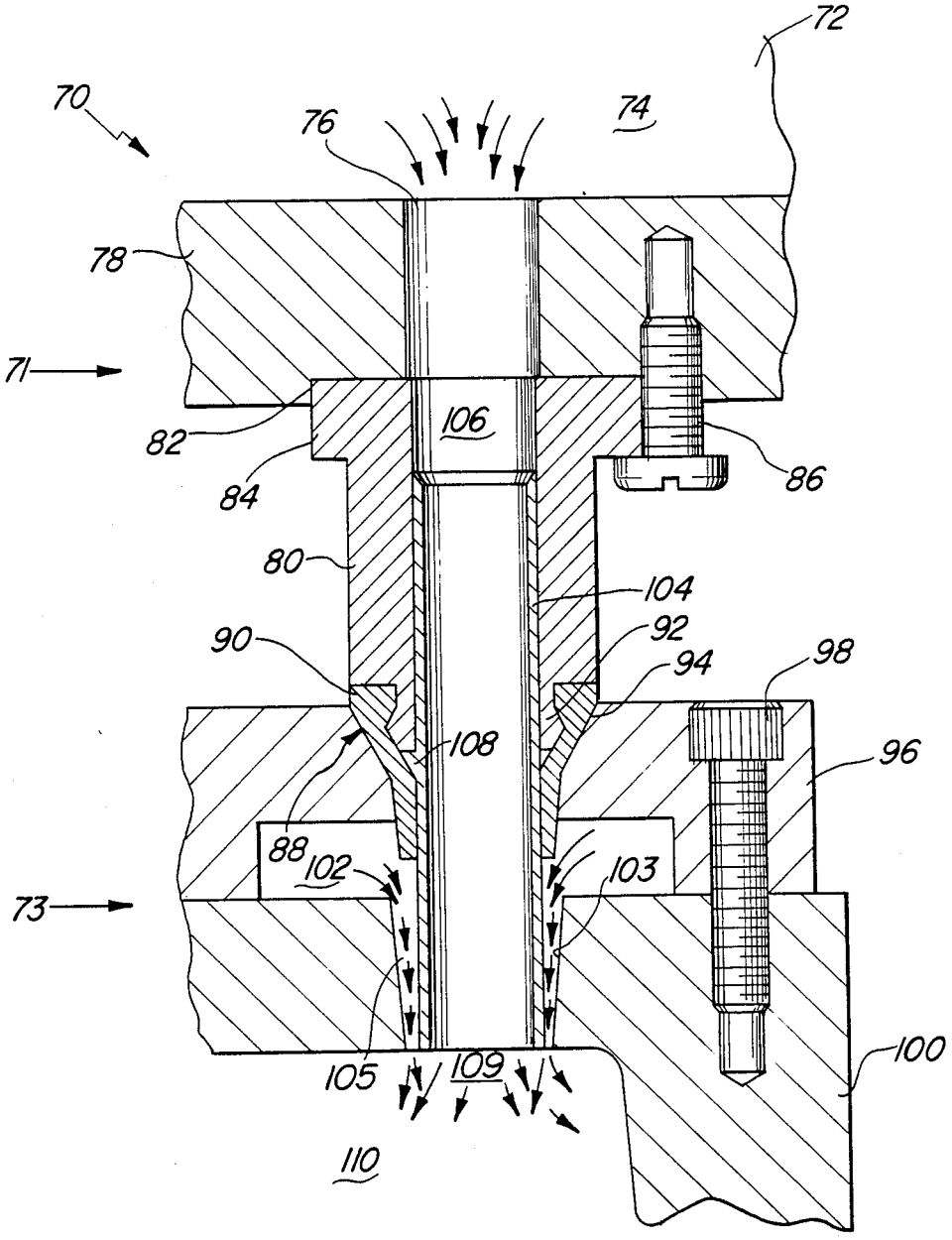
FIG. 2 is a cross-section of a further embodiment of the present invention.

FIG. 2 depicts another embodiment of the forming apparatus of the present invention is shown generally at 70 having an injector head 71 and forming base 73. Injector head 71 includes a magazine 72 having a container 74 for forming material, a discharge bore 76 provided in a blow plate 78 and a conduit 80. In this embodiment, the surface of plate 78, opposite magazine 72, is counter-sunk at 82 for receipt of flange 84 to insure proper sealing. Flange 84 is retained by fasteners 86. Of course, other methods of sealing conduit 80 to plate 78 are within the intended scope of this invention.

Attached at the opposite end of conduit 80 is a resilient nozzle 88. Nozzle 88 is mounted to conduit 80 by complimentary interfitting tabs 90 and 92.

Forming base 73 includes an additive manifold defined by plate 96 and a form in the nature of a forming box 100. Nozzle 88 is received within a counter-sunk opening 94 formed in the surface of additive manifold 96 which is mounted to forming box 100 by fasteners 98. Manifold 96 has a partially hollow interior which forms additive chamber 102. Axially aligned with opening 94 is a bore 103 in forming box 100. As described in the previous embodiment, injector head 71 and forming box 73 are relatively reciprocal to permit the insertion of conduit 80.

To separate chamber 102 from the discharging forming material 74, a liner or inner sleeve 104 is inserted into bore 106 of conduit 80. Tabs 108 are provided on liner 104 to insure proper positioning. The outer wall of liner 104 is spaced from the inner wall of bore 103 to form a passage 105 between chamber 102 and cavity 110. In this manner, additive can be forced from chamber 102 along passage 105 into cavity 110. Liner 104 also permits adjustable positioning of conduit 80 with respect to bore 103 by telescoping liner 104 with respect to conduit 80.

In this embodiment, a separate mixing region is not defined. The additive and forming material intermix in region 109 within cavity 110 immediately after being deposited. However, a separated mixing region can be easily added by shortening the length of liner 104 to define a mixing region within bore 103 immediately adjacent cavity 110. Further, the shortened end of liner 104 may be sloped inwardly for improved intermixing of additive and material.

With reference to FIG. 3, another embodiment of the present invention is shown generally at 112 having an injector head 113 and base 115. As before, head 113 and base 115 are relatively reciprocal. Head 113 includes a magazine 114 having a blow plate 116 connected thereto by fasteners 118. A bore 120 is formed in plate 116 for discharge of forming material from a container 122.

A bushing 124 is tightly fitted within bore 120. Bushing 124 has a tubular body portion 126 which tightly engages the wall of bore 120 and a flange 128 which sealingly engages plate 116.

Base 115 includes an additive manifold defined by a plate 130 which is fixedly mounted to a forming box 132 by fasteners 134. Manifold 130 has a partially hollow interior forming an additive chamber 136 between forming box 132 and manifold 130. An opening 138 extends through manifold 130 into chamber 136 and is in axial alignment with a bore 140 in forming box 132. Bore 140 has a larger diameter than opening 138 and both opening 138 and bore 140 are axially aligned with bore 120 in plate 116.

A second bushing 142 is tightly received within opening 138 and extends into bore 140. Bushing 142 has a tubular body portion 141 and a flange 143. In this embodiment, the end of body portion 141 is flush with the top interior surface of forming box 132. Due to the larger diameter of bore 140, a passage 144 is defined by the exterior wall of body portion 141 and the wall of bore 140. Passage 144 extends from chamber 136 to forming cavity 146.

As in the previous embodiment, this embodiment does not have a separate mixing region but mixing occurs in region 145 of the cavity 146 at the inlet 144. As before, a separate mixing region can be added by shortening the bushing 142 to form a mixing region within bore 140.

The method of forming a part will be described with reference to FIG. 1, however, it is to be understood that the method is intended for use in all embodiments of this invention and any equivalent embodiments thereof. The method of forming includes the steps of first pressurizing container or magazine 12 to force the forming material 14 through conduit 20. Simultaneously with pressuring container 12, chamber 36 is pressurized to force additive through passage 40 to be discharged at the discharge end of conduit 20. By controlling the pressures applied to magazine 12 and chamber 36 the quantity and mixing of additive and material 14 can be controlled. Once cavity 22 has filled, the preseure to both magazine 12 and chamber 36 is stopped. At this time, a purge fluid, such as air is forced into passage 40 which forces the additive throughout the forming cavity to insure proper distribution.

It is to be understood that the term "curing additive" as used herein is intended to mean any liquid, particulate, or other material which is flowable. The curing additive may, for example, comprise sand having a curing agent added thereto.

The method preferrably employs a so-called "ashland" cold box. In this method, foundry sand is mixed with a resin which can be polymerized by the action of a catalyst. As an example, the catalyst may be triethylamine or dimethylethylamine. The catalyst is added to a gas such as carbon dioxide to facilitate injection.

OPERATION

Referring now to FIG. 1, the operation of apparatus 10 is as follows. A forming box 21 is positioned under plate 16 such that bores 18 and 19 are in alignment. Typically this will be done with a conveyor system so that successive forming boxes can be filled. Once in position conduit 20 and tube 38 are inserted into bore 19 for the simultaneous discharge of additive and forming material 14.

The resin coated sand is forced through conduit 20 and the catalyst gas is forced through passage 40 into mixing region 61 where the two intermix. This immediately begins the curing process. Since the catalyst and sand are almost immediately blown out of region 61 into forming cavity 22, the initiation of the curing process in region 61 is not a problem. The advantage of the mixing immediately before discharge into the cavity is the rapid and complete mixing of catalyst and resin coated sand before deposit in cavity 22. The catalyst is more evenly distributed when compared to the distribution obtained in conventional "gassing" stations.

When the cavity 22 is filled, the flow from container 12 and chamber 36 is stopped. Purge fluid is then passed through passage 40 to force the catalyst throughout the sand. The conduit 20 and tube 38 are then removed from bore 19 to allow another forming box 21 to be aligned. It should be noted here that a conventional forming apparatus may be retrofitted with the injector of the present invention.

The operation of the apparatus shown in FIGS. 2 and 3 is identical to that of FIG. 1 except for the mounting of the additive manifold (96,130) on the forming box (100,132) rather than on the blow plate (16).

We claim:

1. Apparatus for forming a part from chemically curable, particulate material such as treated sand, including a source (12, 72, 122) of said particulate material, a source (36, 102, 136) of a curing additive for curing said particulate material, a form (21, 100, 132) having a forming cavity (22, 110, 146) therein for forming said part and an inlet (19, 103, 140) through which the particulate material can be introduced from the source (12, 72, 122) of particulate material into the forming cavity (22, 110, 146) and an injector (11, 71, 112) connected with said source (12, 72, 122) of particulate material for simultaneously introducing said particulate material and said curing additive into said forming cavity (22, 110, 146), said injector (11, 71, 112) comprising a conduit (20, 104, 142) having a discharge end insertable into said inlet (19, 103, 140) for directing particulate material from said source (12, 72, 122) through said discharge end portion into said cavity (22, 110, 146), characterized by a passage (40, 103, 144) concentrically surrounding said conduit (20, 104, 142) and being connected with said source (36, 102, 136) of curing additive said passage (40, 103, 144) terminating at the discharge end of said conduit and discharging said additive into a region (61, 109, 145) at the discharging end of said conduit (20, 104, 142) whereby causing intermixing of said particulate material and additive in said region (61, 109, 145) as said particulate material is introduced into said cavity (22, 110, 146).

2. The apparatus of claim 1, characterized in that the passage (40) is formed by a tube (38) concentraically surrounding said conduit (20) and being connected with said injector (11) having a hollow nozzle (60) at its forward end protruding past the end of said conduit (20), and into said inlet (19), the interior of said nozzle defining said mixing region (61).

3. The apparatus of claim 1, characterized in that said passage (105, 144) is formed by a bore (103, 140) in a forming box (100, 132) into which said conduit (104, 142) of the injector (71) is insertable through a manifold (96, 130) forming said source (102, 136) of a curing additive and being mounted to said forming box (100, 132).

4. The apparatus of claim 2, characterized in that a resilient nozzle (88) surrounds said conduit (104) where it extends through said manifold (96).

5. The apparatus of claim 2, characterized in that said conduit is formed by two bushings (124, 142), one bushing (124) being tightly fitted within a bore (120) of a blow plate (116), the other bushing (142) being tightly received within a bore (138) in said manifold (130), and both bushings (124, 142) being tightly connected by flanges (128, 143).

6. The apparatus of claim 2 characterized by having a manifold (96, 130) fixedly attached to said form (100, 132) defining an additive chamber (102, 136) comprising said source of additive material said additive chamber (102, 136) surrounding the exterior of said inlet (103, 140), said manifold (96, 130) having an outer wall having an opening (94, 138) aligned with said inlet (103, 140), said conduit (104, 142) inserted through said additive chamber (102, 136) and into said inlet (103, 140), said injector (71, 112) including sealing means (88, 128, 142) sealing said conduit (104, 142) passing through said inlet (103, 140), with a clearance space therebetween defining said passage (103, 144).

7. The apparatus according to claim 2 wherein said injector (11, 71, 112) includes a resilient nozzle (60, 88) sealing said conduit (20, 104) to said inlet (19, 103) upon insertion of said conduit (20, 104) into said inlet (19, 103).

8. The apparatus according to claim 2 further including sealing means (61, 88, 128, 142) operable upon insertion of said conduit (20, 104, 142) into said inlet (19, 103, 140) sealing said inlet (19, 103, 140) to said injector (11, 71, 112).

* * * * *